US008699904B2

(12) United States Patent
Okamoto et al.

(10) Patent No.: US 8,699,904 B2
(45) Date of Patent: Apr. 15, 2014

(54) FIXING DEVICE AND IMAGE FORMING APPARATUS CAPABLE OF SUPPRESSING VARIATION IMAGE DENSITY

(75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Syoichi Kaneko, Ishioka (JP); Yoshihiro Sonohara, Hitachi (JP); Keisuke Kubota, Hitachinaka (JP); Takashi Kagami, Mito (JP); Hiroyuki Shimada, Zama (JP)

(73) Assignee: Ricoh Company, Limited, Tokyo (JP)

( * ) Notice: Subject to any disclaimer, the term of this patent is extended or adjusted under 35 U.S.C. 154(b) by 485 days.

(21) Appl. No.: 12/434,223

(22) Filed: May 1, 2009

(65) Prior Publication Data

US 2009/0274477 A1 Nov. 5, 2009

(30) Foreign Application Priority Data

May 2, 2008 (JP) ..... 2008-120435

(51) Int. Cl.
*G03G 15/20* (2006.01)
*G03G 15/00* (2006.01)

(52) U.S. Cl.
CPC ..... *G03G 15/2064* (2013.01); *G03G 15/2078* (2013.01); *G03G 15/5029* (2013.01); *G03G 15/205* (2013.01); *G03G 15/5004* (2013.01)
USPC ..... 399/69; 399/45; 399/122; 399/331

(58) Field of Classification Search
CPC ..... G03G 15/2078; G03G 15/5029
USPC ..... 399/38, 67, 69, 75, 122, 320, 328–332; 219/216, 244
See application file for complete search history.

(56) References Cited

U.S. PATENT DOCUMENTS 5,300,996 A * 4/1994 Yokoyama et al. ..... 399/69
5,306,381 A * 4/1994 Nakazawa et al. ..... 399/69

(Continued)

FOREIGN PATENT DOCUMENTS

JP 9-319243 12/1997
JP 3090983 7/2000

(Continued)

OTHER PUBLICATIONS

U.S. Appl. No. 12/434,213, filed May 1, 2009, Okamoto, et al.

(Continued)

*Primary Examiner* — Benjamin Schmitt
(74) *Attorney, Agent, or Firm* — Oblon, Spivak, McClelland, Maier & Neustadt, L.L.P.

(57) ABSTRACT

A fixing device includes a rotatable first nip formation member, a rotatable second nip formation member, a first heater, a second heater, and a controller. The second nip formation member is provided under the first nip formation member to contact the first nip formation member to form a fixing nip portion between the first nip formation member and the second nip formation member. The first heater heats the first nip formation member. The second heater heats the second nip formation member. The controller supplies a portion of power to the second heater and the remainder of power to the first heater when a plurality of sheets having a sheet weight not greater than about 100 g/m$^2$ passes through the fixing nip portion continuously.

11 Claims, 5 Drawing Sheets

(56) References Cited

U.S. PATENT DOCUMENTS

| | | | | |
|---|---|---|---|---|
| 5,678,153 | A | 10/1997 | Okamoto et al. | |
| 5,679,462 | A | 10/1997 | Soga et al. | |
| 6,411,785 | B1 * | 6/2002 | Ogawahara et al. | 399/69 |
| 6,647,221 | B1 * | 11/2003 | Furuyama | 399/69 |
| 6,980,762 | B2 * | 12/2005 | Bogoshian | 399/328 |
| 7,509,085 | B2 | 3/2009 | Yoshinaga et al. | |
| 2005/0276625 | A1 * | 12/2005 | Cho | 399/69 |
| 2006/0177232 | A1 | 8/2006 | Ehara et al. | |
| 2006/0198646 | A1 * | 9/2006 | Funabiki et al. | 399/45 |
| 2007/0237554 | A1 | 10/2007 | Mitsuya et al. | |
| 2008/0013995 | A1 * | 1/2008 | Kubota et al. | 399/333 |
| 2008/0170896 | A1 | 7/2008 | Kubota et al. | |
| 2008/0292348 | A1 * | 11/2008 | Furuyama | 399/69 |

FOREIGN PATENT DOCUMENTS

| | | | |
|---|---|---|---|
| JP | 2004-151474 | | 5/2004 |
| JP | 2004-233390 | A | 8/2004 |
| JP | 2006-243334 | A | 9/2006 |
| JP | 2007-272032 | A | 10/2007 |
| JP | 2008-040442 | | 2/2008 |
| JP | 2008-65349 | | 3/2008 |

OTHER PUBLICATIONS

U.S. Appl. No. 12/434,195, filed May 1, 2009, Okamoto, et al.
U.S. Appl. No. 12/434,288, filed May 1, 2009, Okamoto, et al.
U.S. Appl. No. 12/453,193, filed May 1, 2009, Okamoto, et al.
U.S. Appl. No. 12/453,189, filed May 1, 2009, Okamoto, et al.

* cited by examiner

FIXING DEVICE AND IMAGE FORMING APPARATUS CAPABLE OF SUPPRESSING VARIATION IMAGE DENSITY

CROSS-REFERENCE TO RELATED APPLICATION

The present application is based on and claims priority to Japanese Patent Application No. 2008-120435, filed on May 2, 2008 in the Japan Patent Office, the entire contents of which are hereby incorporated herein by reference.

BACKGROUND OF THE INVENTION

1. Field of the Invention

Exemplary aspects of the present invention relate to a fixing device and an image forming apparatus, and more particularly, to a fixing device and an image forming apparatus including the fixing device for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In one example of a fixing device included in such image forming apparatuses, a pressing member presses against a fixing member to form a fixing nip portion between the pressing member and the fixing member. When a sheet bearing a toner image passes through the fixing nip portion, the fixing member and the pressing member apply heat and pressure to the sheet bearing the toner image to fix the toner image on the sheet. The fixing member is heated by a heater, such as a resistance heater, a halogen lamp heater, an induction heater, or a magnetic heater.

When a plurality of sheets continuously passes through the fixing nip portion to fix toner images on the plurality of sheets in a single print job, a predetermined control for controlling power supply to the heater is performed to maintain temperature of the fixing member at a predetermined level. However, when a plurality of thin sheets having a sheet weight not greater than about 10 g/m$^2$ passes through the fixing nip portion continuously, image density or gloss may vary among toner images formed on the plurality of thin sheets.

For example, a plurality of sheets continuously passing through the fixing nip portion absorbs heat from the pressing member contacting a back side of a sheet, and thereby decreases temperature of the pressing member gradually. The decreased temperature of the pressing member decreases temperature of a front side of the sheet bearing a toner image, degrading image density or gloss of the toner image. Thus, a last sheet of the plurality of sheets has a low image density or gloss while a first sheet of the plurality of sheets has a high image density or gloss, resulting in variation in image density or gloss among toner images formed on the plurality of sheets within a single print job.

BRIEF SUMMARY OF THE INVENTION

This specification describes below a fixing device according to an exemplary embodiment of the present invention. In one exemplary embodiment of the present invention, the fixing device includes a rotatable first nip formation member, a rotatable second nip formation member, a first heater, a second heater, and a controller. The second nip formation member is provided under the first nip formation member to contact the first nip formation member to form a fixing nip portion between the first nip formation member and the second nip formation member. The first heater heats the first nip formation member. The second heater heats the second nip formation member. The controller supplies a portion of power to the second heater and the remainder of power to the first heater when a plurality of sheets having a sheet weight not greater than about 100 g/m$^2$ passes through the fixing nip portion continuously.

This specification further describes below a fixing device according to an exemplary embodiment of the present invention. In one exemplary embodiment of the present invention, the fixing device includes a rotatable first nip formation member, a rotatable second nip formation member, a first heater, a second heater, and a controller. The second nip formation member is provided under the first nip formation member to contact the first nip formation member to form a fixing nip portion between the first nip formation member and the second nip formation member. The first heater heats the first nip formation member. The second heater heats the second nip formation member. The controller refrains from supplying power to the second heater when a plurality of sheets having a sheet weight greater than about 100 g/m$^2$ passes through the fixing nip portion continuously.

This specification further describes below an image forming apparatus according to an exemplary embodiment of the present invention. In one exemplary embodiment of the present invention, the image forming apparatus includes a fixing device including a rotatable first nip formation member, a rotatable second nip formation member, a first heater, a second heater, and a controller. The second nip formation member is provided under the first nip formation member to contact the first nip formation member to form a fixing nip portion between the first nip formation member and the second nip formation member. The first heater heats the first nip formation member. The second heater heats the second nip formation member. The controller supplies a portion of power to the second heater and the remainder of power to the first heater when a plurality of sheets having a sheet weight not greater than about 100 g/m$^2$ passes through the fixing nip portion continuously.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
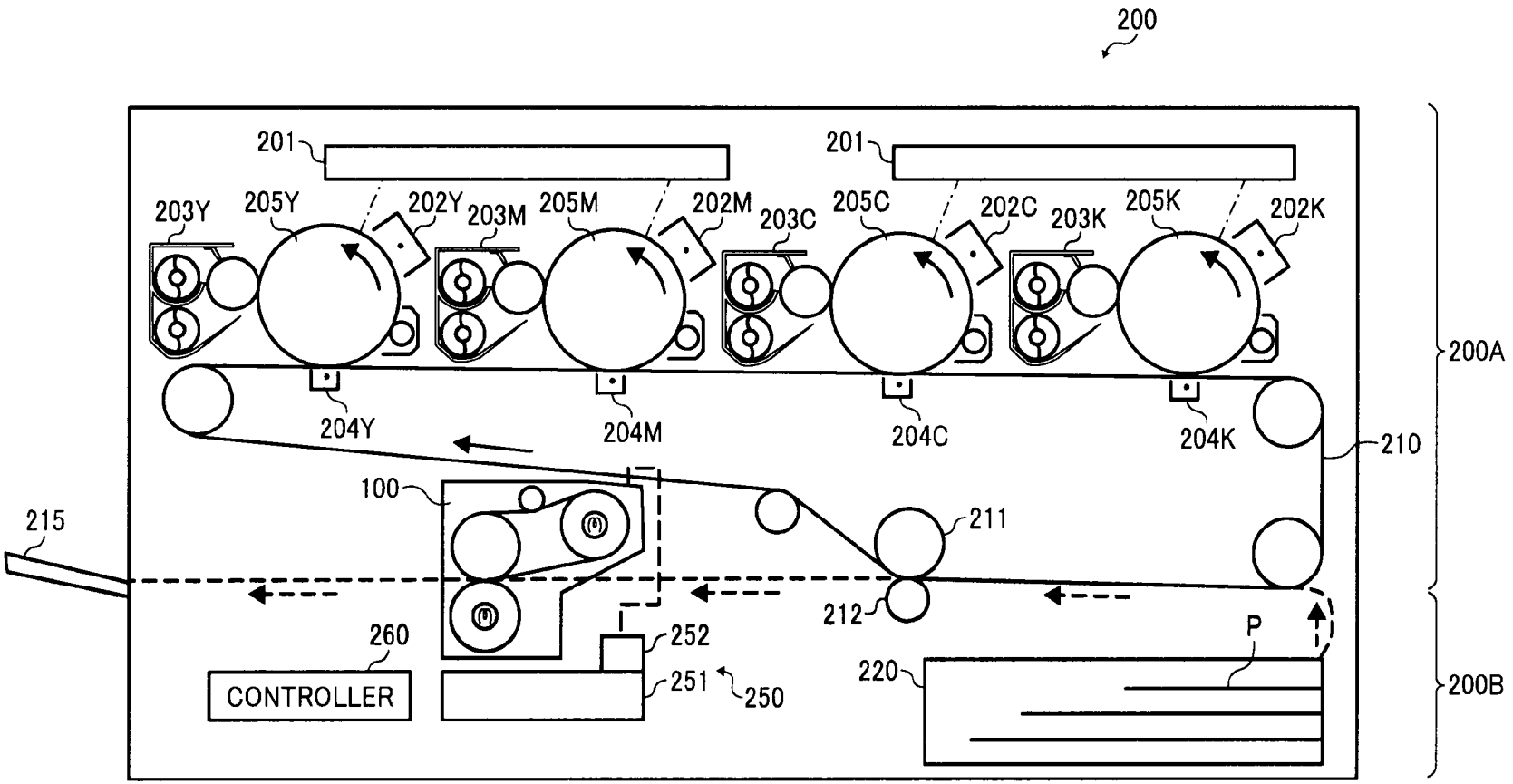
FIG. 1 is a sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 200 according to an exemplary embodiment of the present invention is explained.

As illustrated in FIG. 1, the image forming apparatus 200 includes an image forming device 200A, a sheet supplier 200B, a stacker 215, and a controller 260.

The image forming device 200A includes optical writers 201, chargers 202Y, 202M, 202C, and 202K, development devices 203Y, 203M, 203C, and 203K, first transfer devices 204Y, 204M, 204C, and 204K, photoconductors 205Y, 205M, 205C, and 205K, a transfer belt 210, a roller 211, a transfer roller 212, a fixing device 100, and an oil circulation mechanism 250. The sheet supplier 200B includes a paper tray 220. The oil circulation mechanism 250 includes an oil tank 251 and an oil pump 252.

The image forming apparatus 200 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 200 functions as a tandem type color copier for forming a color image on a recording medium at high speed by electrophotography.

The image forming device 200A is provided at a center portion of the image forming apparatus 200. The sheet supplier 200B is provided under the image forming device 200A. An image reader is provided above the image forming device 200A.

In the image forming device 200A, the transfer belt 210 includes a transfer surface extending in a horizontal direction. A mechanism for forming an image in a complementary color being complementary to a separation color is provided above the transfer belt 210. For example, the photoconductors 205Y, 205M, 205C, and 205K, serving as image carriers for carrying toner images in complementary colors (e.g., yellow, magenta, cyan, and black), are arranged along the transfer surface of the transfer belt 210.

The photoconductors 205Y, 205M, 205C, and 205K are formed of drums which rotate in an identical direction (e.g., counterclockwise in FIG. 1), respectively. The optical writers 201, the chargers 202Y, 202M, 202C, and 202K, the development devices 203Y, 203M, 203C, and 203K, the first transfer devices 204Y, 204M, 204C, and 204K, and cleaners surround the photoconductors 205Y, 205M, 205C, and 205K, respectively, to perform image forming processes while the photoconductors 205Y, 205M, 205C, and 205K rotate. The development devices 203Y, 203M, 203C, and 203K contain yellow, magenta, cyan, and black toners, respectively.

The transfer belt 210 is looped over a driving roller and a driven roller, and opposes the photoconductors 205Y, 205M, 205C, and 205K to move in a direction corresponding to the direction of rotation of the photoconductors 205Y, 205M, 205C, and 205K. The transfer roller 212 opposes the roller 211 serving as a driven roller.

In the sheet supplier 200B, the paper tray 220 loads sheets P serving as a recording medium. A conveyance mechanism feeds the sheets P loaded on the paper tray 220 one by one toward the transfer roller 212. For example, the conveyance mechanism separates an uppermost sheet P from other sheets P loaded on the paper tray 220, and conveys the sheet P toward the transfer roller 212. A conveyance path provided between the transfer roller 212 and the fixing device 100 conveys the sheet P in a horizontal direction.

The following describes image forming operations performed by the image forming apparatus 200. The charger 202Y uniformly charges a surface of the photoconductor 205Y. The optical writer 201 forms an electrostatic latent image on the charged surface of the photoconductor 205Y according to image data sent by the image reader. The development device 203Y for containing the yellow toner makes the electrostatic latent image formed on the photoconductor 205Y visible as a yellow toner image. The first transfer device 204Y applies a predetermined bias to the yellow toner image formed on the photoconductor 205Y to transfer the yellow toner image onto the transfer belt 210. Similarly, magenta, cyan, and black toner images are formed on the photoconductors 205M, 205C, and 205K, respectively, and sequentially transferred onto the transfer belt 210 by an electrostatic force so that the yellow, magenta, cyan, and black toner images are superimposed on the transfer belt 210 to form a color toner image on the transfer belt 210.

The transfer roller 212 transfers the color toner image from the transfer belt 210 onto the sheet P conveyed by the roller 211 and the transfer roller 212. The sheet P bearing the color toner image is further conveyed to the fixing device 100. The fixing device 100 fixes the color toner image on the sheet P. The sheet P bearing the fixed color toner image is sent to the stacker 215 via an output path.

The oil tank 251 collects oil used in the fixing device 100 to improve property for separating the sheet P from the fixing device 100. The oil pump 252 resupplies oil contained in the oil tank 251 to the fixing device 100. The oil tank 251 and the oil pump 252 serve as the oil circulation mechanism 250 (e.g., an oil circulation system) provided for the fixing device 100. The controller 260 controls operations of the image forming apparatus 200.

Figure 2:
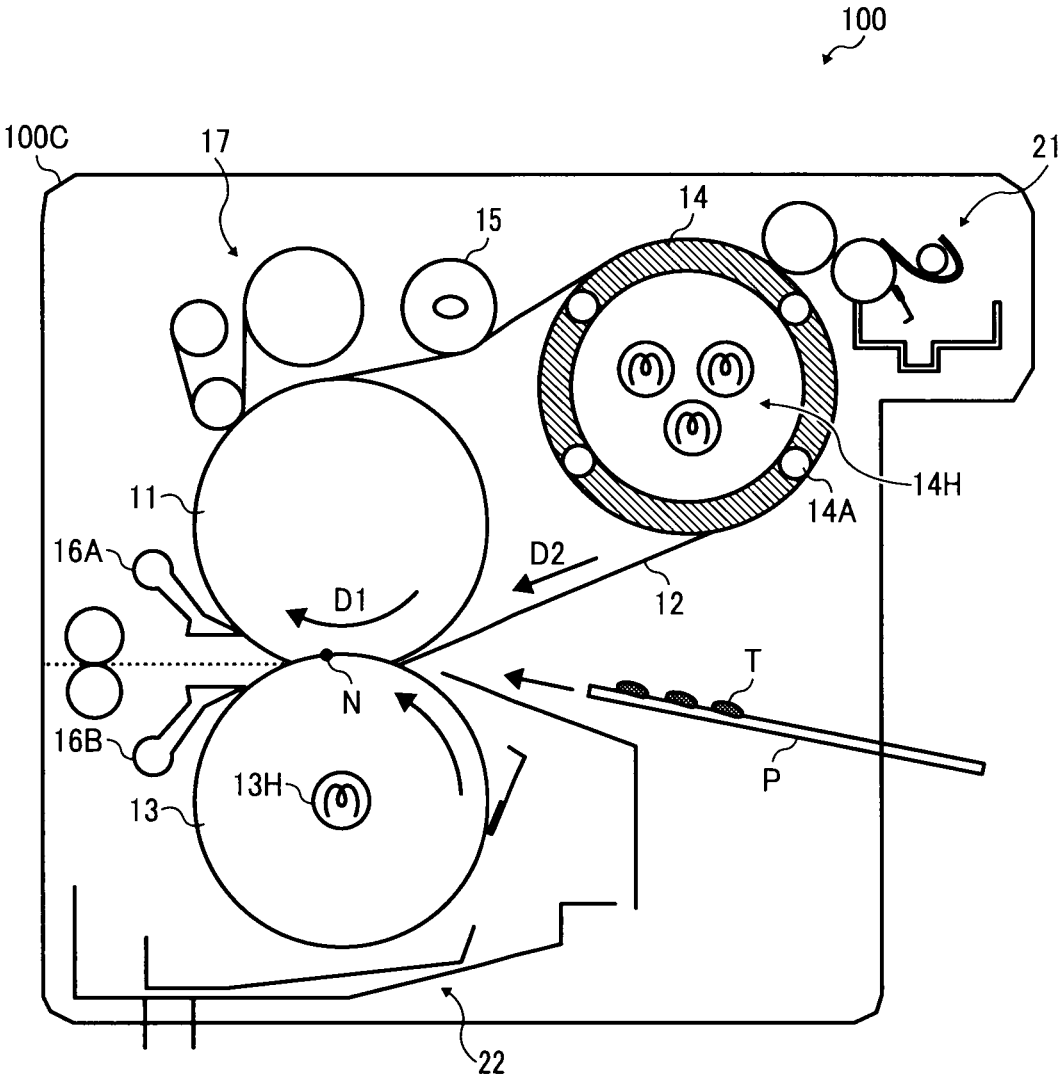
FIG. 2 is a sectional view of a fixing device included in the image forming apparatus shown in FIG. 1.

FIG. 2 is a sectional view of the fixing device 100. The fixing device 100 includes a fixing cover 100C, a fixing roller 11, a fixing belt 12, a pressing roller 13, a heater 13H, a heating roller 14, a heat pipe 14A, a heater 14H, a tension roller 15, separation nails 16A and 16B, a cleaning mechanism 17, and oil appliers 21 and 22.

The fixing roller 11, the fixing belt 12, the pressing roller 13, the heating roller 14, the separation nails 16A and 16B, and the cleaning mechanism 17 are provided inside the fixing cover 100C. The fixing belt 12, serving as a fixing member and a first nip formation member, is looped or stretched over the fixing roller 11 and the heating roller 14 with predetermined tension. The pressing roller 13, serving as a pressing member and a second nip formation member, is provided under the fixing belt 12, and rotatably presses against the fixing belt 12 to form a fixing nip portion N between the fixing belt 12 and the pressing roller 13. The fixing belt 12 and the pressing roller 13 apply heat and pressure to a sheet P bearing a toner image T at the fixing nip portion N to fix the toner image T on the sheet P. The separation nail 16A is provided at an exit side of the fixing nip portion N in such a manner that a head of the separation nail 16A contacts or is disposed close to the fixing belt 12. The separation nail 16A includes a surface coated with fluorine to prevent a sheet P from wrapping around the fixing belt 12. The separation nail 16B is provided at the exit side of the fixing nip portion N in such a manner that a head of the separation nail 16B contacts the pressing roller 13. The separation nail 16B includes a surface coated with fluorine to prevent a sheet P from wrapping around the pressing roller 13. The cleaning mechanism 17 cleans the fixing belt 12 by pressing a cleaning web against the fixing belt 12.

A thermistor, serving as a first temperature detector, is provided outside the fixing belt 12 to detect surface temperature of the fixing belt 12. Similarly, a thermistor, serving as a second temperature detector, is provided outside the pressing roller 13 to detect surface temperature of the pressing roller 13.

The fixing belt 12 has an endless belt shape and has a double-layer structure in which an elastic layer, such as a silicon rubber layer, is formed on a base including nickel, stainless steel, and/or polyimide. The fixing roller 11 includes metal serving as a core metal and silicon rubber. In order to shorten a warm-up time period of the fixing device 100, the fixing roller 11 may include foamed silicon rubber so that the fixing roller 11 does not absorb heat from the fixing belt 12 easily.

The heating roller 14 is formed of a hollow roller including aluminum or iron. The heater 14H, such as a halogen heater, serves as a heat source and a first heater, and is provided inside the heating roller 14. For example, the heater 14H includes three flat halogen heaters having rated power of about 1,000 W and providing flat heat distribution in a full width (e.g., a length in an axial direction) of the heating roller 14.

A plurality of heat pipes 14A, which is formed of hollow pipes, is provided in a thick wall of the heating roller 14. For example, the heat pipes 14A are embedded in the thick wall of the heating roller 14 in such a manner that the heat pipes 14A are evenly spaced in a circumferential direction of the heating roller 14 and that a longitudinal direction of the heat pipes 14A corresponds to a longitudinal direction (e.g., a width direction or the axial direction) of the heating roller 14. The heat pipes 14A improve heat transmission from the heater 14H to a surface of the heating roller 14, and thereby the heating roller 14 uniformly heats the fixing belt 12 quickly. For example, when a flat halogen heater is used as the heater 14H, uniform heat distribution can be provided in a width direction of a small size sheet, such as an A4 size sheet in portrait orientation.

When the fixing device 100 is driven, in a state in which the tension roller 15 presses against the fixing belt 12 to apply proper tension to the fixing belt 12, the fixing roller 11 rotates clockwise in FIG. 2 in a direction of rotation D1 to rotate the fixing belt 12 clockwise in FIG. 2 in a direction of rotation D2 in which the fixing belt 12 feeds a sheet P out of the fixing nip portion N. Thus, the rotating fixing belt 12 rotates the pressing roller 13. Alternatively, instead of the fixing roller 11, the pressing roller 13 or the heating roller 14 may drive and rotate the fixing belt 12. In order to fix a toner image T on a sheet P, the heater 14H provided inside the heating roller 14 generates heat to heat the fixing belt 12 until the thermistor, serving as the first temperature detector, detects that the fixing belt 12 is heated up to a predetermined temperature (e.g., a proper fixing temperature). According to this exemplary embodiment, the fixing belt 12, that is, an endless belt, serves as a fixing member. Alternatively, a fixing roller, for example, a hollow cylindrical roller, may serve as a fixing member.

The pressing roller 13 is formed of a cylindrical roller in which an elastic layer including silicon rubber is provided on a core metal including aluminum or iron. A pressure application-release device moves the pressing roller 13 toward the fixing belt 12 to cause the pressing roller 13 to apply pressure to the fixing belt 12 and moves the pressing roller 13 away from the fixing belt 12 to release pressure applied by the pressing roller 13 to the fixing belt 12. When the fixing device 100 is driven, the pressure application-release device pushes the pressing roller 13 toward the fixing belt 12 to apply constant pressure to the fixing belt 12.

The heater 13H, serving as a second heater, is provided inside the pressing roller 13, and generates heat to heat the pressing roller 13 until the thermistor, serving as the second temperature detector, detects that the pressing roller 13 is heated up to a predetermined temperature as needed, for example, to fix a toner image T on a sheet P. The heater 13H includes one flat halogen heater having rated power of about 1,000 W, which is identical to the rated power of the heater 14H, and providing flat heat distribution in a full width (e.g., a length in an axial direction) of the pressing roller 13.

According to this exemplary embodiment, the pressing roller 13 having a roller shape serves as a pressing member. Alternatively, an endless belt looped over at least two rollers may serve as a pressing member. In this case, the heater 13H is disposed to heat one of the at least two rollers.

In the fixing device 100, a surface of the fixing belt 12 is heated up to a predetermined temperature in a state in which the fixing belt 12 and the pressing roller 13 are driven and rotated. When a sheet P bearing an unfixed toner image T passes through the fixing nip portion N, that is, when the sheet P moves leftward in FIG. 2, the fixing belt 12 and the pressing roller 13 apply heat and pressure to the sheet P at the fixing nip portion N to melt and fix the unfixed toner image T on the sheet P.

When the sheet P bearing the fixed toner image T is discharged from the fixing nip portion N, the sheet P may adhere to or wrap around the fixing belt 12 or the pressing roller 13. To address this, the oil appliers 21 and 22, serving as first and second oil appliers, apply oil to the fixing belt 12 and the pressing roller 13 to improve property for separating the sheet P from the fixing belt 12 and the pressing roller 13, respectively. The applied oil may be heat-resistant fixed oil, such as silicon oil. When the head of the separation nail 16A or 16B contacts a leading edge of the sheet P, the separation nail 16A or 16B separates the sheet P from the fixing belt 12 or the pressing roller 13, respectively. The sheet P discharged from the fixing nip portion N passes through a predetermined discharge path and is sent out of the fixing device 100.

The oil appliers 21 and 22 apply a proper amount of oil to the fixing belt 12 and the pressing roller 13, respectively. The separation nails 16A and 16B provided at the exit side of the fixing nip portion N operate as needed. Accordingly, the sheet P is discharged out of the fixing nip portion N to the exit side of the fixing nip portion N without adhering to or wrapping around the fixing belt 12 or the pressing roller 13.

As described above, the image forming apparatus 200 (depicted in FIG. 1) including the fixing device 100 can provide improved fixing and separation functions, and therefore can handle various types of paper, such as thin paper and thick paper, and various types of image formation, such as a narrower top margin on a sheet.

Predetermined power is supplied to the fixing device 100 to heat the fixing belt 12 and the pressing roller 13. For example, the predetermined power is distributed to the heaters 14H and 13H to control heating of the fixing belt 12 and the pressing roller 13, that is, to control turning on and off of the heaters 14H and 13H, respectively. An external power source, such as a commercial power source supplying a current of 15A at a voltage of 100 V, supplies power to the image forming apparatus 200 depicted in FIG. 1 including the fixing device 100. A portion of the supplied power (e.g., total power) is supplied to drivers (e.g., a motor) and system devices (e.g., a scanner including a light source used for reading an image) included in the image forming apparatus 200, and the remainder of power is supplied to the fixing device 100 to heat the fixing belt 12 and the pressing roller 13. On the other hand, when the image forming apparatus 200 includes a storage device (e.g., an electric double layer condenser or an electric double layer capacitor capable of charging and discharging) serving as a secondary power source, power supplied by the secondary power source is added to the total power.

Figure 3:
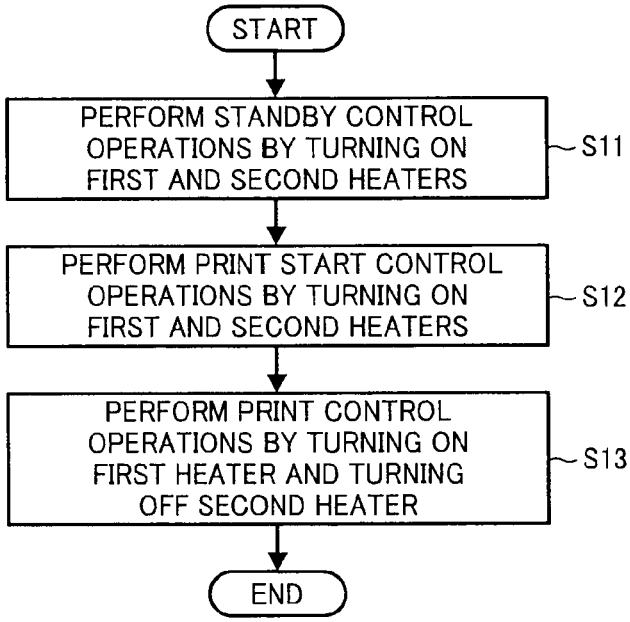
FIG. 3 is a flowchart illustrating a control procedure for controlling heating of a fixing belt and a pressing roller included in the fixing device shown in FIG. 2.
Figure 4:
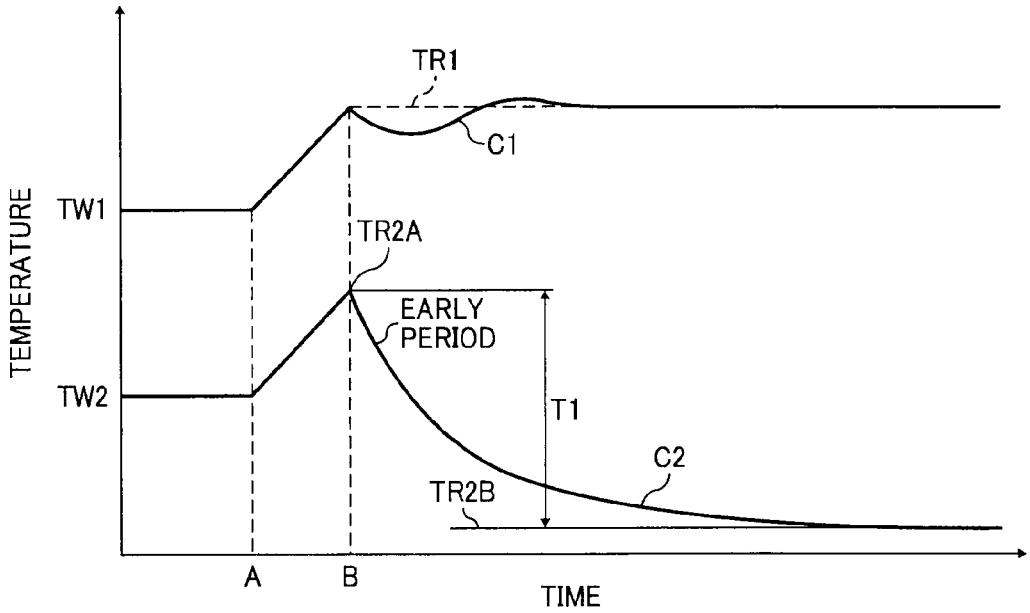
FIG. 4 is a timing chart illustrating a temperature profile of a fixing belt and a pressing roller included in the fixing device shown in FIG. 2.

Referring to FIGS. 2 to 4, the following describes a control procedure for controlling heating of the fixing belt 12 and the pressing roller 13 performed in a conventional fixing device having a structure equivalent to the above-described structure of the fixing device 100. FIG. 3 is a flowchart illustrating the control procedure. FIG. 4 is a timing chart illustrating a temperature profile of the fixing belt 12 and the pressing roller 13 in the conventional fixing device. In FIG. 4, a curve C1 represents temperature of the fixing belt 12, and a curve C2 represents temperature of the pressing roller 13.

In step S11, the controller 260 depicted in FIG. 1 performs standby control operations in a standby mode until point A illustrated in FIG. 4. For example, when the image forming apparatus 200 depicted in FIG. 1 is in the standby mode in which the image forming apparatus 200 is on standby when driving of the fixing device 100 starts or after a previous print job is finished, the controller 260 rotates the fixing belt 12 and separates the pressing roller 13 from the fixing belt 12 to release pressure applied by the pressing roller 13 to the fixing belt 12 and to stop the pressing roller 13. Simultaneously, power supplied by an external power source (e.g., a commercial power source) turns on the heaters 14H and 13H, serving as the first and second heaters, to heat the fixing belt 12 and the pressing roller 13 up to a fixing belt standby temperature TW1 and a pressing roller standby temperature TW2, respectively.

In other words, the fixing device 100 performs the following standby control operations in the standby mode. The fixing belt 12 rotates, and the pressing roller 13 stops rotating while releasing pressure applied to the fixing belt 12. Power is supplied to the heater 14H to turn on the heater 14H. For example, two halogen heaters of the heater 14H are turned on and one halogen heater of the heater 14H is turned off to maintain temperature of the fixing belt 12 at a predetermined temperature (e.g., the fixing belt standby temperature TW1 of about 175 degrees centigrade). Similarly, power is supplied to the heater 13H to turn on the heater 13H. For example, one halogen heater of the heater 13H is turned on to maintain temperature of the pressing roller 13 at a predetermined temperature (e.g., the pressing roller standby temperature TW2 of about 125 degrees centigrade).

In step S12, the controller 260 performs print start control operations after receiving a print start signal or an image formation start signal at point A until starting a print job or starting an image formation job at point B illustrated in FIG. 4. For example, when the controller 260 receives a print request, that is, a print start signal or an image formation start signal, from an external device or the like, the controller 260 causes the pressing roller 13 to contact the fixing belt 12 so that the pressing roller 13 applies pressure to the fixing belt 12 while the pressing roller 13 and the fixing belt 12 rotate. Power supplied by the external power source turns on the heaters 14H and 13H, serving as the first and second heaters, to heat the fixing belt 12 and the pressing roller 13 from the fixing belt standby temperature TW1 and the pressing roller standby temperature TW2 up to target fixing temperatures, which are a fixing belt control temperature TR1 and a pressing roller early temperature TR2A, respectively.

In other words, the fixing device 100 performs the following first heating control operations. The fixing belt 12 rotates, and the pressing roller 13 is rotated by the rotating fixing belt 12 while the pressing roller 13 contacts the fixing belt 12 to apply pressure to the fixing belt 12. Power is supplied to the heater 14H to turn on the heater 14H. For example, two halogen heaters of the heater 14H are turned on and one halogen heater of the heater 14H is turned off to heat the fixing belt 12 up to a predetermined temperature (e.g., the fixing belt control temperature TR1 of about 155 degrees centigrade for thin paper, a range from about 170 degrees centigrade to about 175 degrees centigrade for medium thickness paper, or about 200 degrees centigrade for thick paper). Similarly, power is supplied to the heater 13H to turn on the heater 13H. For example, one halogen heater of the heater 13H is turned on to heat the pressing roller 13 up to a predetermined temperature (e.g., the pressing roller early temperature TR2A in a range from about 140 degrees centigrade to about 150 degrees centigrade).

In step S13, the controller 260 performs print control operations after starting a print job at point B illustrated in FIG. 4. For example, when the temperature of the fixing belt 12 reaches the fixing belt control temperature TR1, the controller 260 starts a printing or image forming process. When the pressing roller 13 applies pressure to the fixing belt 12 while the pressing roller 13 and the fixing belt 12 rotate, power supplied by the external power source turns on the heater 14H serving as the first heater to heat the fixing belt 12 so that the fixing belt 12 maintains the fixing belt control temperature TR1. By contrast, the heater 13H serving as the second heater is turned off.

In other words, the fixing device 100 performs the following second heating control operations. The fixing belt 12 rotates, and the pressing roller 13 is rotated by the rotating fixing belt 12 while the pressing roller 13 contacts the fixing belt 12 to apply pressure to the fixing belt 12. Power is supplied to the heater 14H to turn on the heater 14H. For example, three halogen heaters of the heater 14H are turned on to maintain the fixing belt 12 at a predetermined temperature (e.g., the fixing belt control temperature TR1). By contrast, power is not supplied to the heater 13H to turn off the heater 13H.

Under the above-described control operations, when a plurality of sheets P continuously passes through the fixing nip portion N at a sheet conveyance speed of about 400 mm/s, for example, in a print job for printing or forming toner images on the plurality of sheets P, image density may vary among the toner images formed on the plurality of sheets P. Even when an identical toner image is formed on the plurality of sheets P, the toner images formed on the plurality of sheets P may provide different glosses, respectively. For example, a first sheet P of the plurality of sheets P provides a high gloss; however, a last sheet P of the plurality of sheets P provides a low gloss. Such phenomenon may appear when a plurality of sheets P of medium thickness having a sheet weight not greater than about 130 g/m$^2$ passes through the fixing nip portion N continuously, and may often appear when a plurality of thin sheets P having a sheet weight not greater than about 100 g/m$^2$ passes through the fixing nip portion N continuously.

Variation in image density may occur due to fluctuation in temperature of the pressing roller 13 during the printing or image forming process. For example, the pressing roller 13 has a highest temperature, that is, the pressing roller early temperature TR2A during an early period immediately after point B. However, sheets P continuously passing through the fixing nip portion N absorb heat from the pressing roller 13, and thereby the temperature of the pressing roller 13 gradually decreases to a pressing roller later temperature TR2B (e.g., a temperature not higher than about 120 degrees centigrade). Generally, fluctuation in temperature of the pressing roller 13 which contacts a back side of a sheet P not bearing a toner image T may not affect temperature of a front side of the sheet P bearing the toner image T which contacts the fixing belt 12. However, when fluctuation in temperature of the pressing roller 13, that is, a temperature difference T1 obtained by subtracting the pressing roller later temperature TR2B from the pressing roller early temperature TR2A is great and thin paper having a sheet weight not greater than about 100 g/m$^2$ is used as sheets P, fluctuation in temperature of the pressing roller 13 may affect the temperature of the front side of the sheet P bearing the toner image T which contacts the fixing belt 12, resulting in variation in image density or gloss among toner images T formed on a plurality of sheets P continuously passing through the fixing nip portion N in a print job. Specifically, when a plurality of sheets P continuously passing through the fixing nip portion N has a sheet weight not greater than about 100 g/m$^2$, toner images T on some sheets P of the plurality of sheets P, which pass through the fixing nip portion N during the early period in which the pressing roller 13 has the pressing roller early temperature TR2A, may have a high image density or gloss. By contrast, toner images T on some sheets P of the plurality of sheets P, which pass through the fixing nip portion N during a later period in which the pressing roller 13 has the pressing roller later temperature TR2B, may have a low image density or gloss.

Image density (ID) indicates an amount calculated based on a result of measurement performed by using light with a light reflection densitometer (e.g., Macbeth densitometer) to show ability to absorb light on a surface of a toner image. For example, a more intensely colored image shows a higher image density. When solid toner images having an identical color are compared, a glossier toner image shows a higher image density.

When thin sheets P having a sheet weight not greater than about 100 g/m$^2$ pass through the fixing nip portion N continuously, a substantial amount of power is not supplied to the heater 14H for heating the fixing belt 12. In the conventional fixing device, such shortage of power supplied to the heater 14H may cause variation in image density among toner images T formed on a plurality of sheets P in a single print job.

Figure 5:
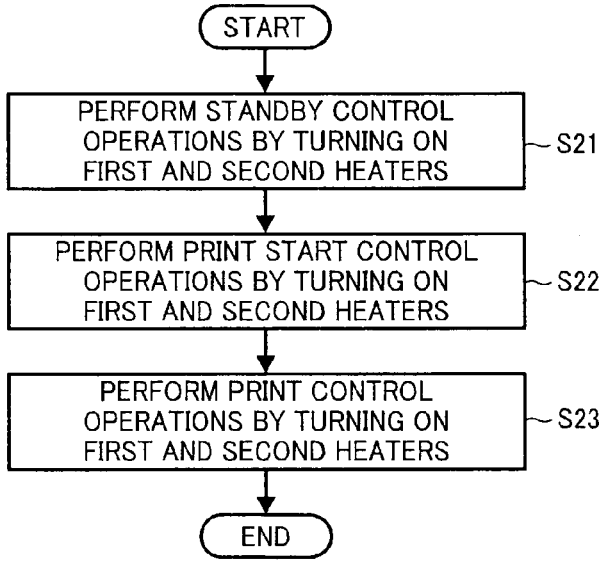
FIG. 5 is a flowchart illustrating another control procedure for controlling heating of a fixing belt and a pressing roller included in the fixing device shown in FIG. 2.
Figure 6:
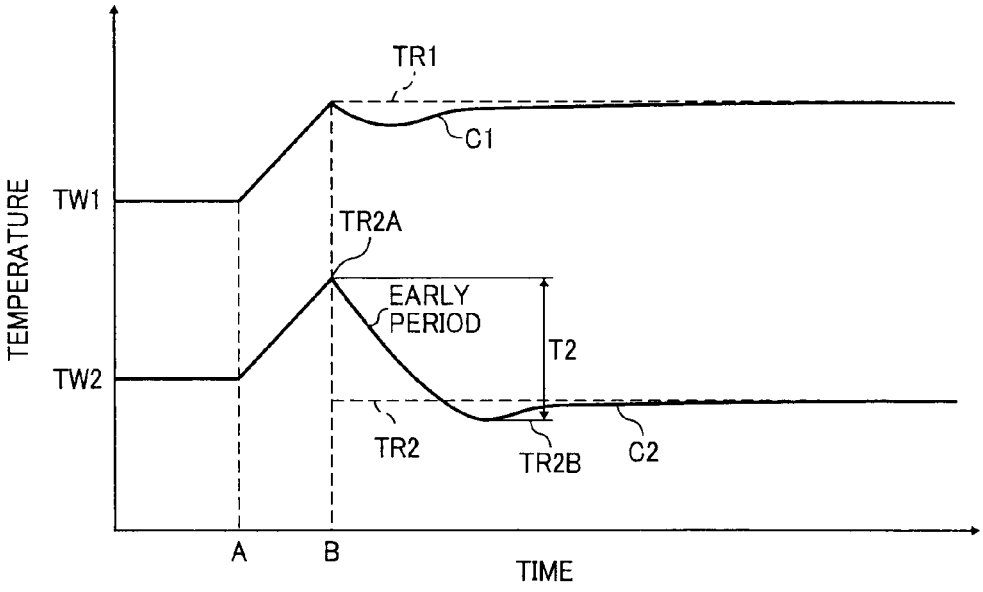
FIG. 6 is a timing chart illustrating another temperature profile of a fixing belt and a pressing roller included in the fixing device shown in FIG. 2.

Referring to FIGS. 2, 5, and 6, the following describes a control procedure for controlling heating of the fixing belt 12 and the pressing roller 13 performed in the fixing device 100 according to this exemplary embodiment of the present invention. FIG. 5 is a flowchart illustrating the control procedure. FIG. 6 is a timing chart illustrating a temperature profile of the fixing belt 12 and the pressing roller 13 in the fixing device 100.

In step S21, the controller 260 depicted in FIG. 1 performs the standby control operations in the standby mode until point A illustrated in FIG. 6.

In step S22, the controller 260 performs the print start control operations (e.g., the first heating control operations) after receiving a print start signal or an image formation start signal at point A until starting a print job or starting an image formation job at point B illustrated in FIG. 6.

The standby control operations in step S21 and the print start control operations in step S22 are equivalent to the above-described standby control operations in step S11 and the above-described print start control operations in step S12, respectively. Therefore, the descriptions about the standby control operations in step S21 and the print start control operations in step S22 are omitted.

In step S23, the controller 260 performs print control operations after starting a print job at point B illustrated in FIG. 6. For example, when the temperature of the fixing belt 12 reaches the fixing belt control temperature TR1, the controller 260 starts a printing or image forming process. In order to continuously pass a plurality of sheets P having a sheet weight not greater than about 100 g/m$^2$ through the fixing nip portion N, when the pressing roller 13 applies pressure to the fixing belt 12 while the pressing roller 13 and the fixing belt 12 rotate, power supplied by the external power source turns on the heater 14H serving as the first heater to heat the fixing belt 12 so that the fixing belt 12 maintains the fixing belt control temperature TR1. The heater 13H serving as the second heater is also turned on to heat the pressing roller 13.

In other words, the fixing device 100 performs the following second heating control operations. The fixing belt 12 rotates, and the pressing roller 13 is rotated by the rotating fixing belt 12 while the pressing roller 13 contacts the fixing belt 12 to apply pressure to the fixing belt 12. Power is supplied to the heater 14H to turn on the heater 14H. For example, two halogen heaters of the heater 14H are turned on and one halogen heater of the heater 14H is turned off to maintain the fixing belt 12 at a predetermined temperature (e.g., the fixing belt control temperature TR1). Similarly, power is supplied to the heater 13H to turn on the heater 13H. For example, one halogen heater of the heater 13H is turned on to heat the pressing roller 13 up to a predetermined temperature (e.g., a pressing roller control temperature TR2 of about 125 degrees centigrade).

In step S23, when the plurality of sheets P, which has the sheet weight not greater than about 100 g/m$^2$, passes through the fixing nip portion N continuously, a portion of the supplied power is supplied to the heater 13H serving as the second heater, and the remainder of power is supplied to the heater 14H serving as the first heater to control heating of the fixing belt 12 and the pressing roller 13.

The external power source supplies power to the fixing device 100 to turn on three flat halogen heaters having rated power of about 1,000 W constantly throughout from the standby control operations to the print control operations. According to this exemplary embodiment, control for turning on and off the heaters 14H and 13H does not mean that power is supplied to the heaters 14H and 13H to generate heat constantly, but that the heaters 14H and 13H are turned on and off so that temperatures of the fixing belt 12 and the pressing roller 13 detected by the first temperature detector and the second temperature detector reach target temperatures, respectively.

According to this exemplary embodiment, in order to cause toner images T formed on sheets P during the later period to have gloss closer to gloss of toner images T formed on sheets P during the early period in a print job for printing on a plurality of sheets P, the above-described control operations prevent the temperature of the pressing roller 13 from decreasing even during the later period in the print job. In other words, the above-described control operations control heating of the pressing roller 13 so that a temperature difference T2 between the pressing roller early temperature TR2A and the pressing roller later temperature TR2B is within a predetermined range. For example, the temperature difference T2 obtained by subtracting the pressing roller later temperature TR2B from the pressing roller early temperature TR2A of the pressing roller 13 can be suppressed within about 30 degrees centigrade.

The following describes an experiment performed with the fixing device 100 under the above-described control operations. When a plurality of sheets P continuously passed through the fixing nip portion N at a sheet conveyance speed of about 400 mm/s under the pressing roller early temperature TR2A of the pressing roller 13 in the range from about 140 degrees centigrade to about 150 degrees centigrade and the pressing roller control temperature TR2 of about 125 degrees centigrade, the lowest pressing roller later temperature TR2B of the pressing roller 13 was about 120 degrees centigrade. Under such conditions, solid toner images T in an identical color were formed on a plurality of thin sheets P having a sheet weight not greater than about 100 g/m$^2$ and continuously passing through the fixing nip portion N, respectively, and the Macbeth densitometer measured image density of the solid toner images T formed on the thin sheets P. Some sheets P of the plurality of thin sheets P, which passed through the fixing nip portion N during the early period in which the pressing roller 13 had the pressing roller early temperature TR2A in the range from about 140 degrees centigrade to about 150 degrees centigrade, had image density of about 1.625. Some sheets P of the plurality of thin sheets P, which passed through the fixing nip portion N during the later period in which the pressing roller 13 had the lowest pressing roller later temperature TR2B of about 120 degrees centigrade, had image density of about 1.575 or higher. Namely, the experiment reveals that the fixing device 100 was able to suppress image density deviation or variation in image density or gloss among the toner images T formed on the plurality of thin sheets P continuously passing through the fixing nip portion N in a single print job.

Alternatively, another method for causing toner images T formed on sheets P during the later period to have gloss closer to gloss of toner images T formed on sheets P during the early period in a print job for printing on a plurality of sheets P may suppress increase in temperature of the pressing roller 13 during the early period in which the pressing roller 13 has the pressing roller early temperature TR2A.

For example, when the controller 260 receives a next print request, that is, a print start signal or an image formation start signal from the external device or the like in step S12 illustrated in FIG. 3, the pressing roller 13 does not apply pressure to the fixing belt 12 immediately, but contacts the fixing belt 12 to apply pressure to the fixing belt 12 when a predetermined time period (e.g., a range from about 1 second to about 10 seconds) elapses after the reception of the print request. Such delayed timing for applying pressure to the fixing belt 12 can decrease a nip time period in which the pressing roller 13 and the fixing belt 12 form the fixing nip portion N, and thereby decrease an amount of heat transmitted from the fixing belt 12 to the pressing roller 13. Consequently, the pressing roller early temperature TR2A of the pressing roller 13 can be suppressed at a low temperature during the early period in which leading sheets P of a plurality of sheets P continuously pass through the fixing nip portion N in a print job. Thereafter, the temperature difference T2 between the pressing roller early temperature TR2A and the pressing roller later temperature TR2B of the pressing roller 13 can be small. As a result, variation in image density can be suppressed among toner images T formed on the plurality of sheets P continuously passing through the fixing nip portion N in a single print job.

Yet alternatively, in the print control operations performed in step S23, when a plurality of thick sheets P having a sheet weight greater than about 100 g/m$^2$ passes through the fixing nip portion N continuously, the controller 260 may not supply power to the heater 13H, because fluctuation in temperature of the back side of the thick sheet P, which contacts the pressing roller 13, may not affect temperature of the front side of the thick sheet P, which contacts the fixing belt 12 and bears a toner image T, and thereby may not cause variation in image density among toner images T formed on the plurality of thick sheets P in a print job.

In other words, the fixing device 100 performs the following second heating control operations as shown in step S13 illustrated in FIG. 3. The fixing belt 12 rotates, and the pressing roller 13 is rotated by the rotating fixing belt 12 while the pressing roller 13 contacts the fixing belt 12 to apply pressure to the fixing belt 12. Power is supplied to the heater 14H to turn on the heater 14H. For example, three halogen heaters of the heater 14H are turned on to maintain the fixing belt 12 at a predetermined temperature (e.g., the fixing belt control temperature TR1). By contrast, power is not supplied to the heater 13H to turn off the heater 13H.

In the fixing device 100, the fixing belt 12, serving as a first nip formation member and a fixing member, is provided above the pressing roller 13 serving as a second nip formation member and a pressing member. Alternatively, a fixing member having a roller shape and serving as a first nip formation member may be provided above a pressing member having a belt shape and serving as a second nip formation member, as illustrated in FIG. 7.

Figure 7:
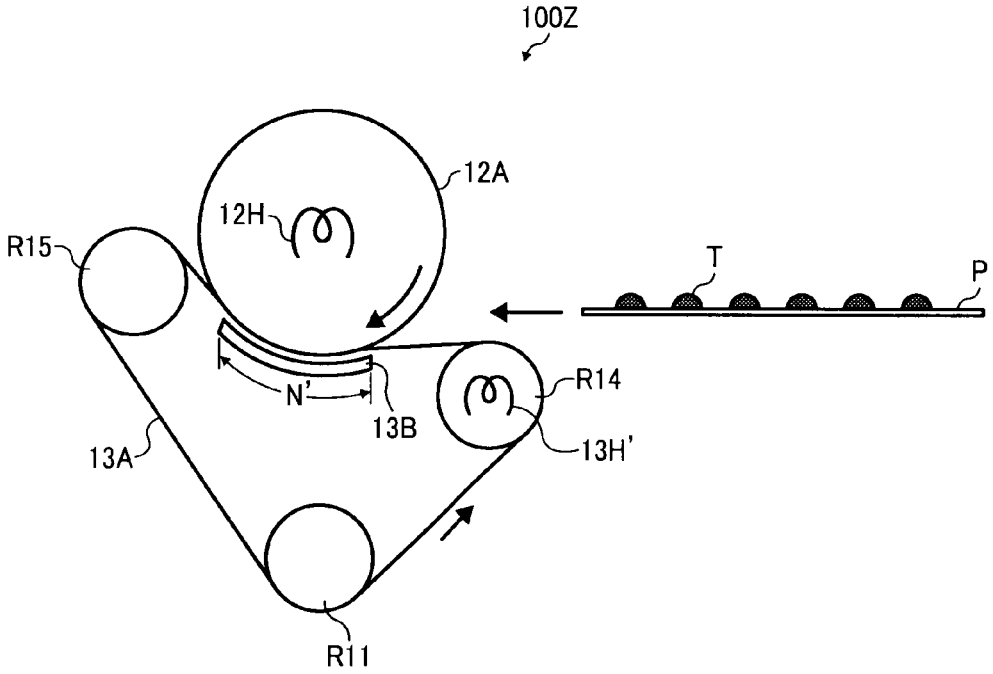
FIG. 7 is a sectional view of a fixing device according to another exemplary embodiment of the present invention.

Referring to FIG. 7, the following describes a fixing device 100Z according to yet another exemplary embodiment. FIG. 7 is a sectional view of the fixing device 100Z. The fixing device 100Z includes a fixing roller 12A, a heater 12H, rollers R11, R14, and R15, a pressing belt 13A, a backup member 13B, and a heater 13H'.

The fixing roller 12A, serving as a first nip formation member, is provided above the pressing belt 13A serving as a second nip formation member, and rotates clockwise in FIG. 7. The pressing belt 13A provided under the fixing roller 12A rotates counterclockwise in FIG. 7, and is looped over the rollers R11, R14, and R15. The backup member 13B faces an inner circumferential surface of the pressing belt 13A to cause the pressing belt 13A to contact the fixing roller 12A and form a fixing nip portion N' between the fixing roller 12A and the pressing belt 13A. The heater 12H, serving as a first heater, is provided inside the fixing roller 12A, and heats the fixing roller 12A. For example, the heater 12H may include three flat halogen heaters. The heater 13H', serving as a second heater, is provided inside the roller R14, and heats the roller R14 so that the roller R14 heats the pressing belt 13A. For example, the heater 13H' may include one flat halogen heater.

Also with the above-described structure of the fixing device 100Z, when a plurality of sheets P having a sheet weight not greater than about 100 g/m$^2$ passes through the fixing nip portion N' continuously, a portion of power used for heating is supplied to one halogen heater of the heater 13H' serving as the second heater, and the remainder of power is supplied to two halogen heaters of the heater 12H serving as the first heater, so as to restrict or suppress fluctuation in temperature of the pressing belt 13A. As a result, variation in image density can be suppressed among toner images T formed on the plurality of sheets P continuously passing through the fixing nip portion N' in a single print job.

Figure 8:
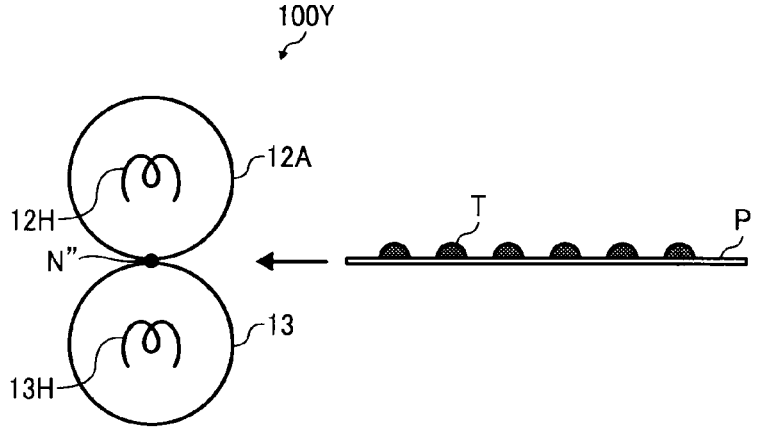
FIG. 8 is a sectional view of a fixing device according to yet another exemplary embodiment of the present invention.

Yet alternatively, a fixing member having a roller shape and serving as a first nip formation member may be provided above a pressing member having a roller shape and serving as a second nip formation member, as illustrated in FIG. 8.

Referring to FIG. 8, the following describes a fixing device 100Y according to yet another exemplary embodiment. FIG. 8 is a sectional view of the fixing device 100Y. The fixing device 100Y includes the fixing roller 12A, the heater 12H, the pressing roller 13, and the heater 13H.

The rotatable fixing roller 12A, serving as a first nip formation member, is provided above the pressing roller 13 serving as a second nip formation member. The pressing roller 13 provided under the fixing roller 12A contacts the fixing roller 12A to form a fixing nip portion N" between the fixing roller 12A and the pressing roller 13. The heater 12H, serving as a first heater, is provided inside the fixing roller 12A, and heats the fixing roller 12A. For example, the heater 12H may include three flat halogen heaters. The heater 13H, serving as a second heater, is provided inside the pressing roller 13, and heats the pressing roller 13. For example, the heater 13H may include one flat halogen heater.

Also with the above-described structure of the fixing device 100Y, when a plurality of sheets P having a sheet weight not greater than about 100 g/m$^2$ passes through the fixing nip portion N" continuously, a portion of power used for heating is supplied to one halogen heater of the heater 13H serving as the second heater, and the remainder of power is supplied to two halogen heaters of the heater 12H serving as the first heater, so as to restrict or suppress fluctuation in temperature of the pressing roller 13. As a result, variation in image density can be suppressed among toner images T formed on the plurality of sheets P continuously passing through the fixing nip portion N" in a single print job.

According to the above-described exemplary embodiments, in a fixing device (e.g., the fixing device 100 depicted in FIG. 2, the fixing device 100Z depicted in FIG. 7, or the fixing device 100Y depicted in FIG. 8), when a plurality of thin sheets, which has a sheet weight not greater than about 100 g/m$^2$ and thereby is subject to fluctuation in temperature of a second nip formation member (e.g., the pressing roller 13 depicted in FIG. 2, the pressing belt 13A depicted in FIG. 7, or the pressing roller 13 depicted in FIG. 8), continuously passes through a fixing nip portion (e.g., the fixing nip portion N depicted in FIG. 2, the fixing nip portion N' depicted in FIG. 7, or the fixing nip portion N" depicted in FIG. 8) in a print job, a second heater (e.g., the heater 13H depicted in FIG. 2, the heater 13H' depicted in FIG. 7, or the heater 13H depicted in FIG. 8) heats the second nip formation member to restrict or suppress fluctuation in temperature of the second nip formation member. Consequently, variation in image density or gloss among toner images formed on the plurality of thin sheets can be suppressed. In other words, toner images having a uniform density can be formed on the plurality of thin sheets.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device, comprising:

a rotatable first nip formation member, which rotates around a circumference of a heating roller;

a rotatable second nip formation member provided under the first nip formation member to contact the first nip formation member to form a fixing nip portion between the first nip formation member and the second nip formation member;

a first heater to heat the first nip formation member and including a plurality of heaters;

a second heater provided within the rotatable second nip formation member to heat the second nip formation member and including at least one heater, the number of the at least one heater of the second heater being smaller than the number of the plurality of heaters of the first heater; and a controller programmed to continuously supply a portion of power to the second heater and the remainder of power to the first heater during an entire time when a plurality of sheets having a sheet weight not greater than about 100 g/m$^2$ are passing through the fixing nip portion continuously, wherein each of the plurality of heaters of the first heater and the at least one heater of the second heater has an identical length in an axial direction of the heating roller and an identical rated power, wherein the controller is programmed to supply a portion of power to the at least one heater of the second heater and the remainder of power to the plurality of heaters of the first heater so as to supply a constant total power to the first heater and the second heater, and wherein the controller is programmed to supply power to the first heater and refrain from supplying power to the second heater during an entire time when a plurality of sheets having a sheet weight greater than about 100 g/m$^2$ are passing through the fixing nip portion continuously.

2. The fixing device according to claim 1, further comprising:

a plurality of heat pipes provided in a wall of the heating roller in a circumferential direction of the heating roller, wherein the plurality of heat pipes transmit heat generated by the first heater to the first nip formation member.

3. The fixing device according to claim 1, wherein the at least one heater of the second heater includes only a single heater.

4. The fixing device according to claim 1, wherein the second nip formation member does not apply pressure to the first nip formation member immediately, but is configured to contact and apply pressure to the first nip formation member when a predetermined time period elapses after reception of a print request.

5. The fixing device according to claim 4, wherein the predetermined time period is from about 1 second to about 10 seconds.

6. An image forming apparatus, comprising:

a fixing device comprising:

a rotatable first nip formation member, which rotates around a circumference of a heating roller;

a rotatable second nip formation member provided under the first nip formation member to contact the first nip formation member to form a fixing nip portion between the first nip formation member and the second nip formation member;

a first heater to heat the first nip formation member and including a plurality of heaters;

a second heater provided within the rotatable second nip formation member to heat the second nip formation member and including at least one heater, the number of the at least one heater of the second heater being smaller than the number of the plurality of heaters of the first heater; and a controller programmed to continuously supply a portion of power to the second heater and the remainder of power to the first heater during an entire time when a plurality of sheets having a sheet weight not greater than about 100 g/m$^2$ are passing through the fixing nip portion continuously, wherein each of the plurality of heaters of the first heater and the at least one heater of the second heater has an identical length in an axial direction of the heating roller and an identical rated power, and wherein the controller is programmed to supply a portion of power to the at least one heater of the second heater and the remainder of power to the plurality of heaters of the first heater so as to supply a constant total power to the first heater and the second heater, and wherein the controller is programmed to supply power to the first heater and refrain from supplying power to the second heater during an entire time when a plurality of sheets having a sheet weight greater than about 100 g/m$^2$ are passing through the fixing nip portion continuously.

7. The image forming apparatus according to claim 6, wherein the fixing device further comprises:

a plurality of heat pipes provided in a wall of the heating roller in a circumferential direction of the heating roller, wherein the plurality of heat pipes transmit heat generated by the first heater to the first nip formation member.

8. The image forming apparatus according to claim 6, wherein the at least one heater of the second heater includes only a single heater.

9. The image forming apparatus according to claim 6, wherein the second nip formation member does not apply pressure to the first nip formation member immediately, but is configured to contact and apply pressure to the first nip formation member when a predetermined time period elapses after reception of a print request.

10. The image forming apparatus according to claim 9, wherein the predetermined time period is from about 1 second to about 10 seconds.

11. A fixing device, comprising:

a heating roller;

a fixing roller;

a rotatable fixing belt, which rotates around a circumference of the heating roller and the fixing roller;

a rotatable pressing roller provided under the fixing belt to contact the fixing belt to form a fixing nip portion between the fixing belt and the pressing roller;

a first heater to heat the fixing belt and including a plurality of heaters;

a second heater provided within the pressing roller to heat the pressing roller and including at least one heater, the number of the at least one heater of the second heater being smaller than the number of the plurality of heaters of the first heater; and a controller programmed to continuously supply a portion of power to the second heater and the remainder of power to the first heater during an entire time when a plurality of sheets having a sheet weight not greater than about 100 g/m$^2$ are passing through the fixing nip portion continuously, wherein each of the plurality of heaters of the first heater and the at least one heater of the second heater has an identical length in an axial direction of the heating roller and an identical rated power, wherein the controller is programmed to supply a portion of power to the at least one heater of the second heater and the remainder of power to the plurality of heaters of the first heater so as to supply a constant total power to the first heater and the second heater, and wherein the controller is programmed to supply power to the first heater and refrain from supplying power to the second heater during an entire time when a plurality of sheets having a sheet weight greater than about 100 g/m$^2$ are passing through the fixing nip portion continuously.

* * * * *